US007699174B2

(12) United States Patent
Allison et al.

(10) Patent No.: US 7,699,174 B2
(45) Date of Patent: Apr. 20, 2010

(54) ELECTRICAL CONNECTOR INTERFACED WITH CONDUCTIVE INK ON A CARDBOARD SUBSTRATE

(75) Inventors: Jeffrey Wayne Allison, Etters, PA (US); Ricardo Lee Koller, Lititz, PA (US); Navin Kanjibhai Patel, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 379 days.

(21) Appl. No.: 11/768,422

(22) Filed: Jun. 26, 2007

(65) Prior Publication Data

US 2009/0001988 A1 Jan. 1, 2009

(51) Int. Cl.
*B65D 83/04* (2006.01)

(52) U.S. Cl. ..... 206/531; 206/532; 206/534; 206/807; 368/10

(58) Field of Classification Search ..... 206/528, 206/531, 532, 534, 534.1, 536, 538, 807; 368/10, 107, 108, 109
See application file for complete search history.

(56) References Cited

U.S. PATENT DOCUMENTS

| | | | | |
|---|---|---|---|---|
| 5,181,189 | A * | 1/1993 | Hafner | 368/10 |
| 6,241,550 | B1 | 6/2001 | Laity et al. | |
| 6,354,848 | B1 | 3/2002 | Billman | |
| 6,575,772 | B1 | 6/2003 | Soubh et al. | |
| 7,104,809 | B1 | 9/2006 | Huang | |
| 7,209,048 | B1 | 4/2007 | Pace et al. | |
| 2005/0181643 | A1 | 8/2005 | Brower et al. | |
| 2007/0084746 | A1 * | 4/2007 | Udo et al. | 206/531 |
| 2007/0095715 | A1 * | 5/2007 | Simon et al. | 206/531 |
| 2007/0246396 | A1 * | 10/2007 | Brollier | 206/534 |
| 2008/0105588 | A1 * | 5/2008 | Tran et al. | 206/534 |

FOREIGN PATENT DOCUMENTS

| | | | |
|---|---|---|---|
| EP | 0157976 | A | 10/1985 |
| EP | 0616391 | A | 9/1994 |
| WO | WO-03/068138 | A | 8/2003 |

OTHER PUBLICATIONS

Search Report for International Application No. PCT/US2008/007849, mailed Sep. 1, 2009.

* cited by examiner

*Primary Examiner*—Jacob K Ackun, Jr.

(57) ABSTRACT

An inventory control system, comprising a blister pack having a pierceable sheet that includes a plurality of printed circuits overlying each of the compartments of the blister pack. The printed circuits are in electrical communication with a connector assembly, the connector assembly being in electrical communication with a removable header. The header is in communication with a microprocessor controlled device having a memory; wherein the microprocessor controlled device determines the contents of the blister pack. The blister pack and connector assembly are removed from the substantially fixed header so the contents can be distributed. As the contents are distributed from the blister pack, the printed circuits are broken. When the connector assembly is reattached to the blister pack, electrical signals transmitted through the connector assembly and the blister pack determines the number of broken circuits, indicative of the contents of the blister pack. The connector assembly is a reusable device that includes a board that provides for electrical communication between the header and the blister pack and also facilitates assembly and removal of the connector to the header.

26 Claims, 12 Drawing Sheets

ELECTRICAL CONNECTOR INTERFACED WITH CONDUCTIVE INK ON A CARDBOARD SUBSTRATE

FIELD OF THE INVENTION

The present invention is directed to a dispensing apparatus, and specifically to a dispensing apparatus that tracks the dispensed product, the dispensing apparatus having a disposable dispensing portion and a reusable portion

BACKGROUND OF THE INVENTION

Certain products have sufficient value that their distribution must be carefully controlled, monitored and recorded. To prevent unauthorized distribution of such products, they are kept under lock and key with limited access until time for distribution, use or sale. There are many products that fall within this description. As an example, one category of products that falls within this description is pharmaceuticals.

Certain pharmaceuticals are maintained in blister packs in a locked area until ready for distribution. When ready for distribution, the blister packs containing the products are removed from locked area. The individual product is removed from the blister pack by the professional responsible for its distribution, and the product is distributed by the professional to the patient. The professional responsible for distribution of the product must maintain meticulous records regarding access and distribution of the product. Nevertheless, despite the procedures for accountability, the current system is subject to mistake, fraud or theft. What is needed is an improved system for tracking access and distribution of valuable products to minimize losses due to mistake, fraud or theft.

SUMMARY OF THE INVENTION

The present invention provides an inventory control system for tracking distribution of valuable or important articles that are sufficiently small that they can be assembled into a blister pack and then dispensed in units from the blister pack. The invention includes the blister pack, a connector assembly mounted to the blister pack and to a header, the header releasably connected to the connector assembly, the header further in communication with a microprocessor-controlled device having a memory.

In accordance with blister pack technology, the blister pack includes a plurality of compartments for retaining or holding a unit amount of an article, the plurality of compartments being assembled to a firm backing material. The compartments on one side of the blister pack are sealed with a pierceable backing material, which, upon piercing, makes the contents of a pierced compartment separable from the blister pack and available for use. The blister pack used in conjunction with the present invention includes a plurality of conductive circuits formed thereon, at least one circuit corresponding to each of the plurality of compartments in the blister pack, the circuit being broken when the backing material is pierced sufficiently to remove an article from a compartment.

The connector assembly is securely but removably mounted to the blister pack, which is to say the connector assembly is mounted to the blister pack so that it can be reused, but not readily disassembled and assembled to the blister pack. The connector assembly includes a board mounted in a housing. A first plurality of connections connect the connector assembly to the circuits on the blister pack. A second plurality of connections connect the connector assembly to the header.

The header is removably connected to the connector assembly so that the header and connector assembly can be readily assembled and diassembled. The header includes a plurality of connections that correspond to the second plurality of connections on the connector assembly. The header is also in communication with a microprocessor-controlled device that has a memory.

In its simplest embodiment, the connector assembly and header test the continuity of each circuit printed on the blister pack of the present invention and transmit information about the status of each circuit to the microprocessor device. Because the connector assembly and header are releasably connected, the connector assembly and blister pack can be separated from the header to facilitate use or movement of the blister pack. Articles can be removed from the blister pack for distribution or use as is well-known. The articles are removed by piercing the backing material on the blister pack, which not only liberates the article within the blister pack, but also breaks a circuit for each unit article removed. The breaking of this circuit is only of significance to the connector assembly of the present invention. When the connector assembly is reconnected to the header, a continuity check can be run through the circuits. The continuity check entails attempting to pass a current through each of the circuits to determine which circuits remain intact and which circuits have been broken. In this manner the number of articles removed from the blister pack from the time that it was removed from the header can be determined and the number or articles still in inventory can also be determined.

The present invention, in its simplest form, can be used for automated inventory control of valuable, small articles that are conducive to packaging in blister packs by determining through continuity checks, the number of circuits broken, and thus, the number of articles removed.

The present invention advantageously can be used to eliminate errors, theft and fraud in distribution or administration of small valuable articles in blister packs that are otherwise difficult to inventory because of their large numbers and small sizes, yet is reusable with new blister packs once the disposable blister packs are spent.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
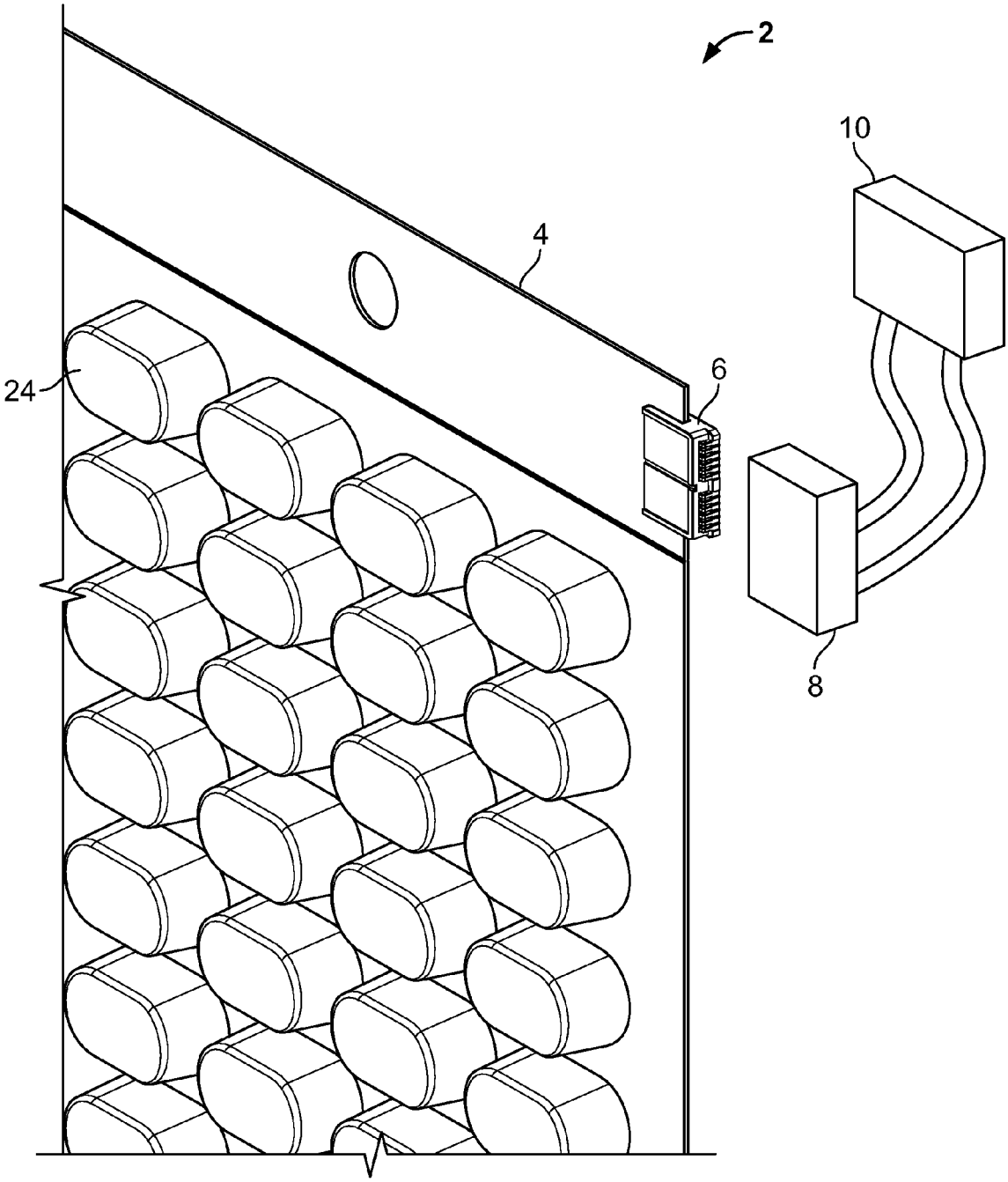
FIG. 1 depicts a schematic of the inventory control system of the present invention.

The present invention is broadly directed to an inventory control system for articles capable of being packaged in blister packs. Broadly, the inventory control system is shown schematically in FIG. 1. The system 2 comprises a blister pack 4, a removable connector assembly 6 attached to blister pack, 4, a header 8 releasably attached to connector assembly 6, and a microprocessor-controlled device having a memory 10 in communication with header 8. An ubiquitous microprocessor-controlled device having a memory usable with the present invention is a computer.

Figure 2:
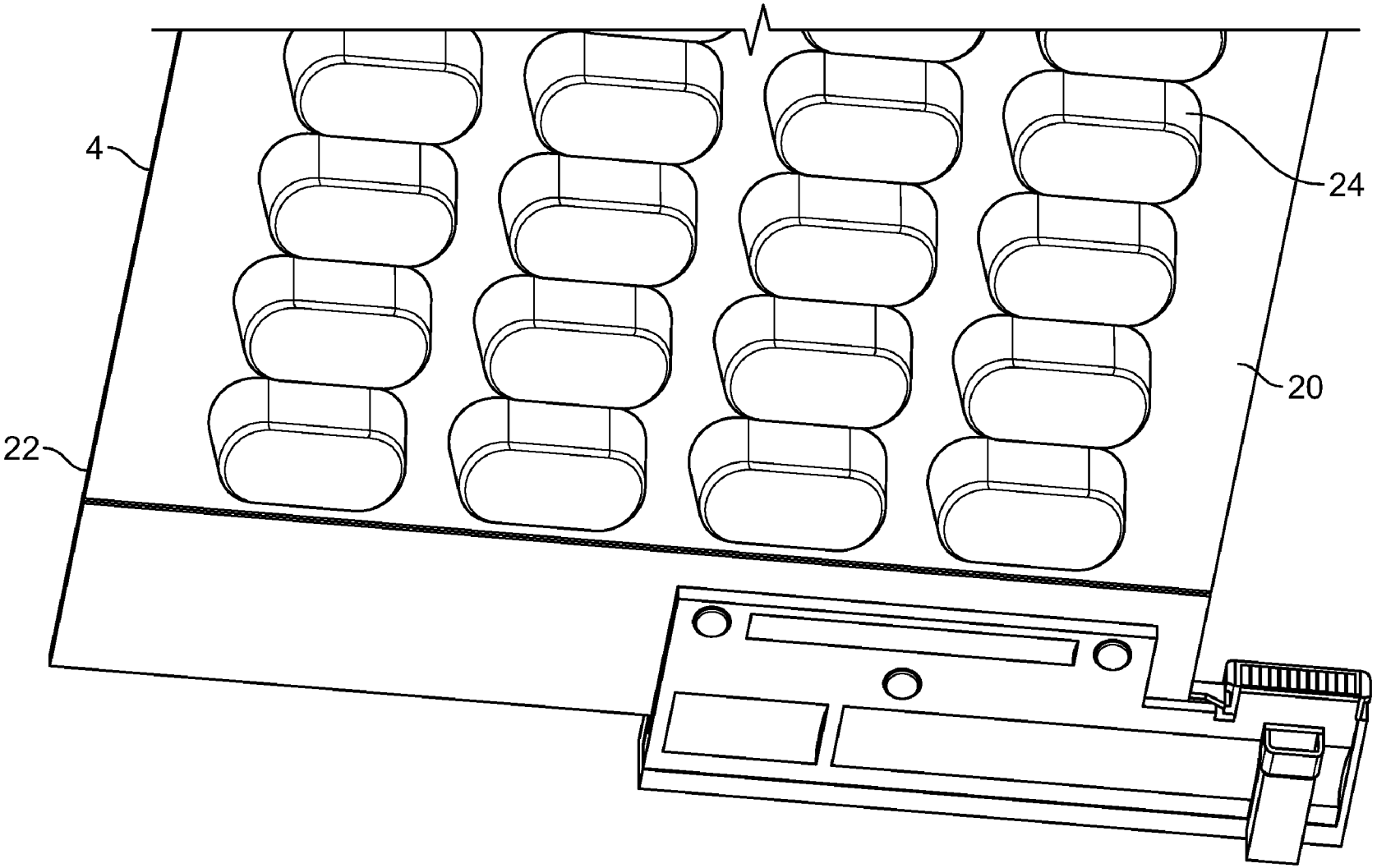
FIG. 2 depicts a blister pack with a connector assembly mounted thereon.

FIG. 2 depicts blister pack 4 having a first side 20 and an opposed second side 22. In accordance with current blister pack technology, compartments 24 of predetermined size extend away from the first side 20. The compartments are sized to hold an article or unit of material. The compartments can be formed integral with a backing material or can be assembled onto a firm or stiff backing material, such as cardboard. Preferably, the article or unit of material held in the blister pack can be seen through the compartments 24, so that the compartments ideally comprise a transparent or translucent plastic.

Figure 3:
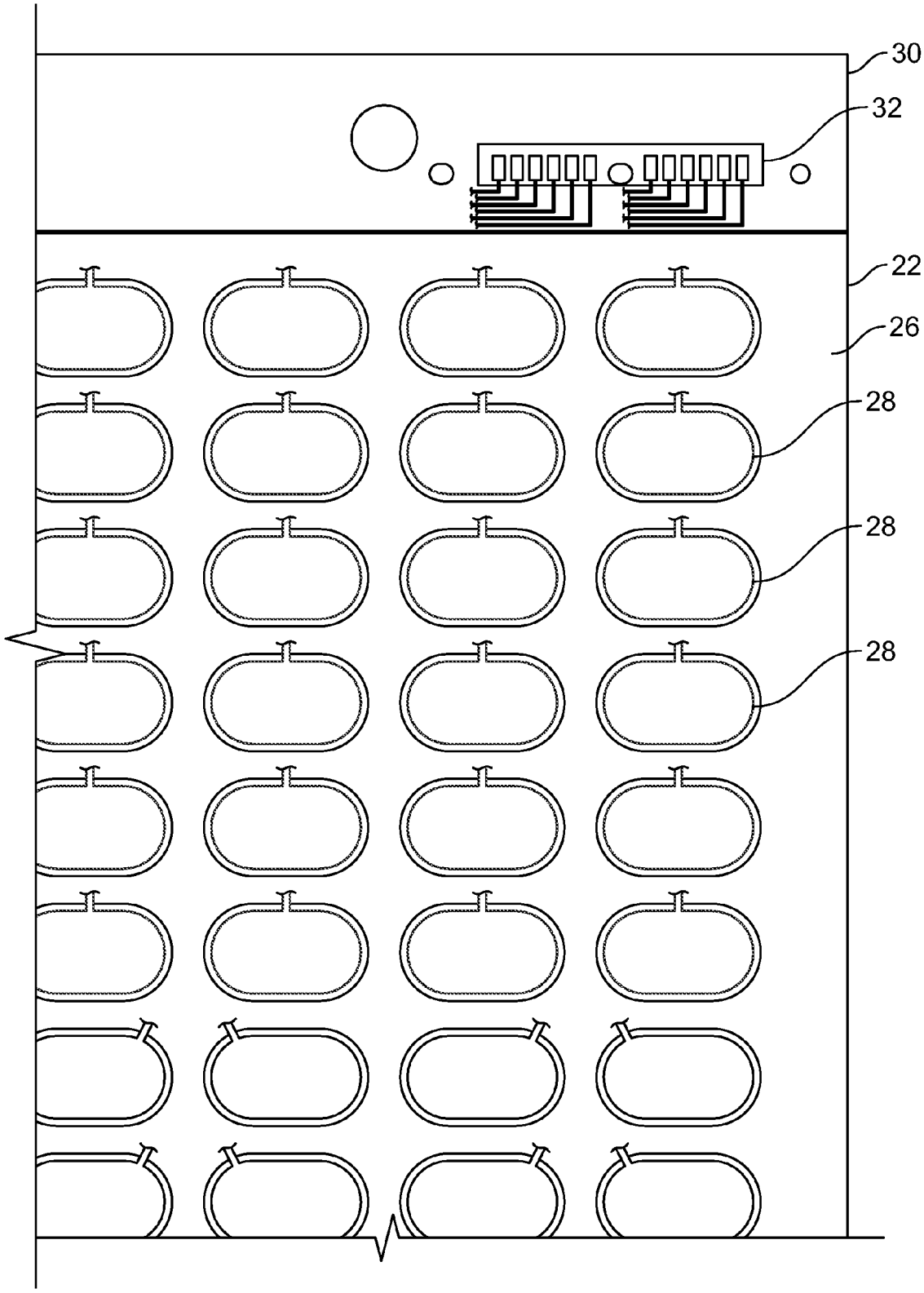
FIG. 3 depicts a second side of blister pack covered with a pierceable sheet having circuits printed on the sheet.

FIG. 3 depicts the second side 22 of blister pack 4. The second side 22 is covered with a pierceable sheet 26. However, this pierceable sheet 26 differs from pierceable sheets commonly found on blister packs in that the pierceable sheet 26 of the present invention includes a plurality of circuits 28 printed on it, a circuit being located over each of the compartments 24. The circuits can be printed using a conductive ink. Each of the circuits 28 extends in an electrically continuous manner toward an edge of the blister pack, preferably a corner 30. As shown in FIG. 1, the portion of the blister pack, here a corner 30, receives a connector 6 such as shown in FIG. 1. As will be developed below, the connector 6 attached to the blister pack 4, connects to the plurality of circuits 28. Referring again to FIG. 3, the plurality of circuits 28 preferably terminate in a landing 32, which facilitates connection to a connector. Like the circuits, the landing also may be printed on the pierceable sheet with a conductive ink.

The blister pack 4 functions similarly to prior art blister packs in dispensing an article or a unit of material. A quick view of either side of the blister pack will disclose which compartments contain an article or a unit of material. Individual compartments are breached by piercing the pierceable sheet and removing the article or unit of material from the blister pack. This is most conveniently done for an article by applying pressure on a selected compartment from the first side in the direction of the second side of the blister pack 4, causing the article to pierce the pierceable sheet. Alternatively, an instrument can be used to pierce the pierceable sheet. Blister pack 4 differs from prior art blister packs in that piercing the pierceable sheet to remove an article also break the circuit printed on the pierceable sheet and overlying the selected compartment.

The pierceable sheet can be any material that can be overlaid onto the blister pack and onto which a circuit can be printed. The current material of choice for pierceable sheet for a blister pack is metal foil. This requires application of a thin layer of a dielectric material between the plurality of circuits and the metal foil in order for the circuit to function properly. However, the material for the pierceable sheet is not limited to foil, as a non-conductive material onto which a circuit can be applied or printed directly may be used.

Figure 4:
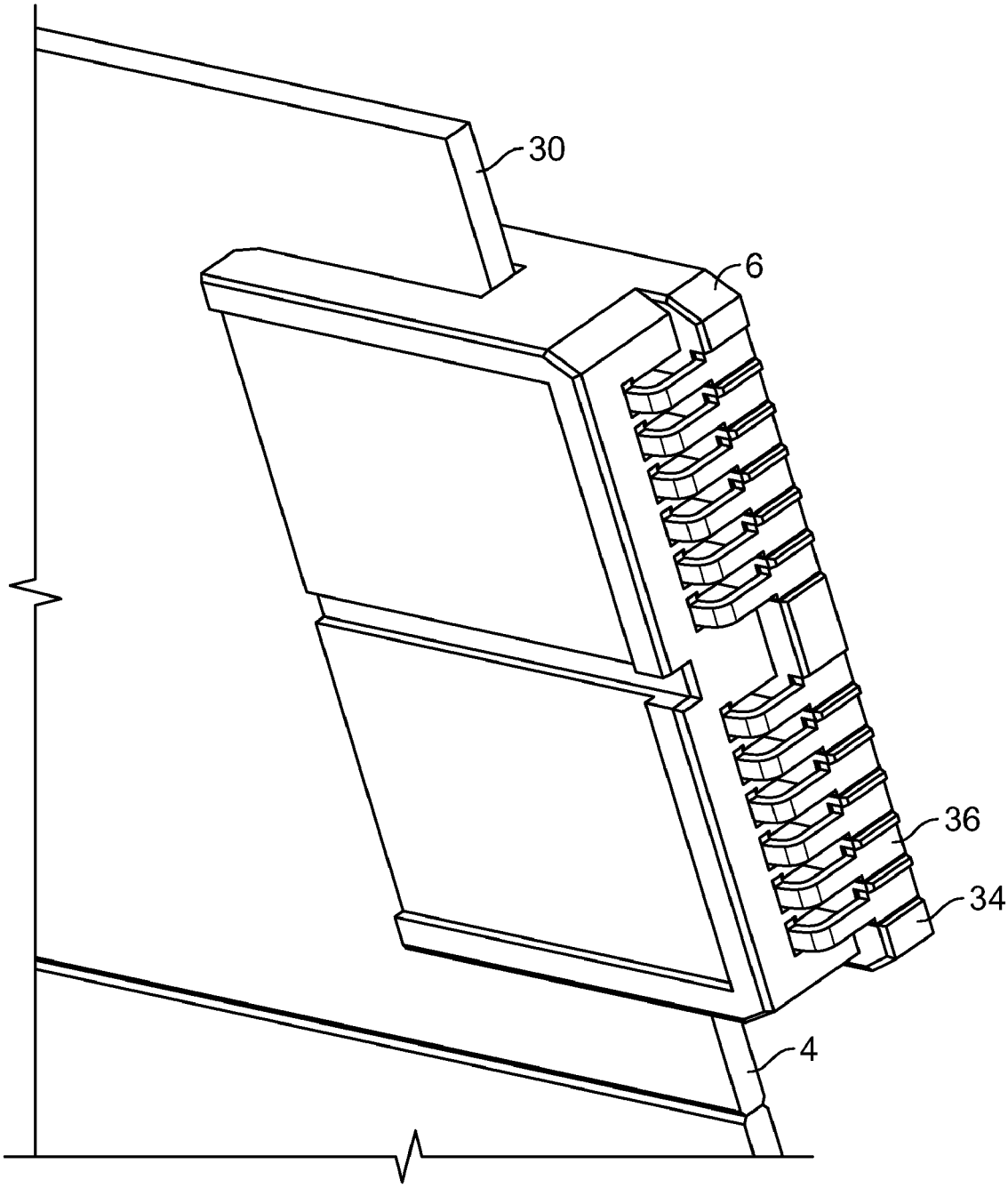
FIG. 4 depicts a connector assembly mounted on a blister board.
Figure 5:
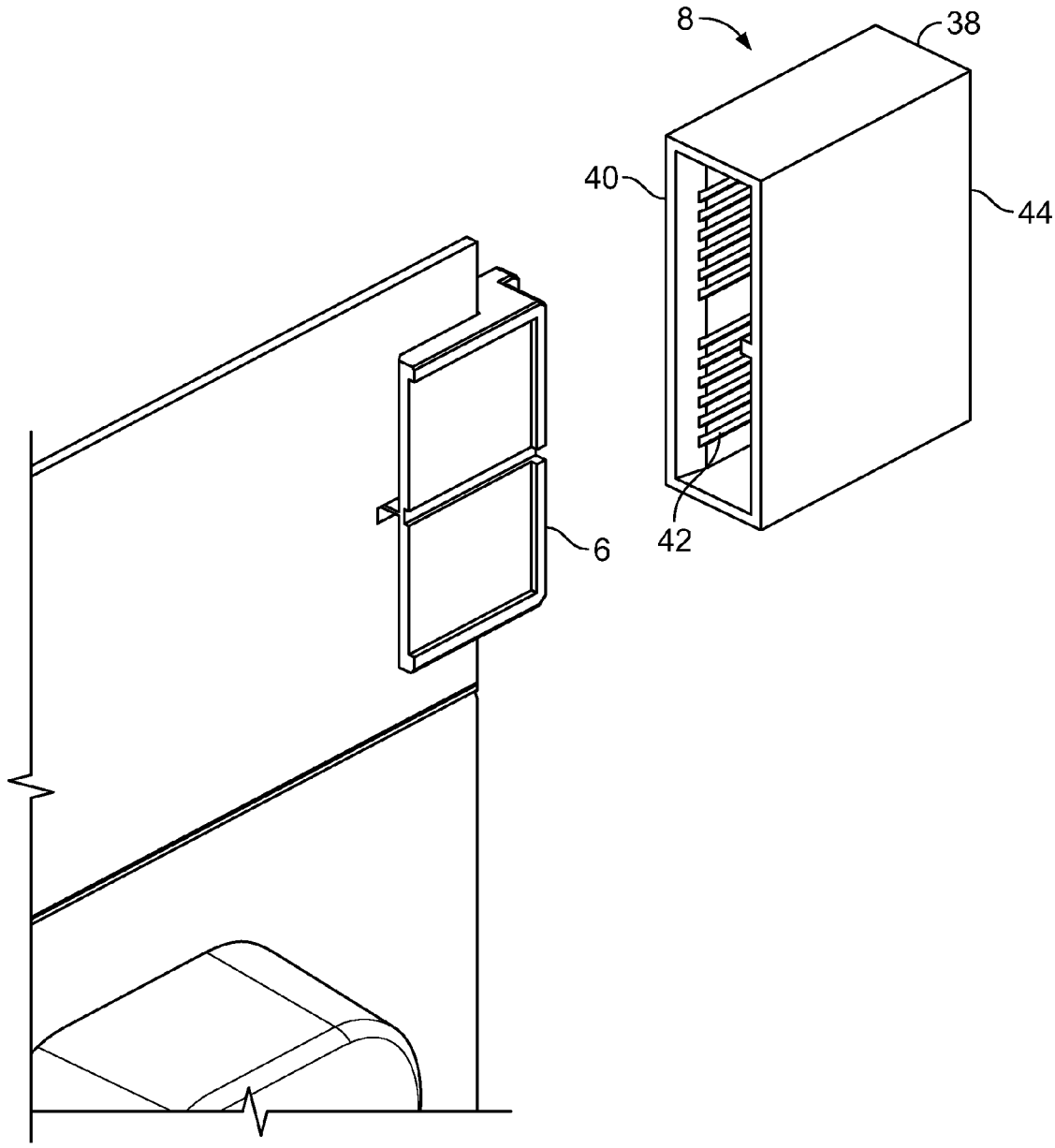
FIG. 5 is an unassembled view of a header and connector assembly mounted on a blister board.

FIG. 4 depicts a connector assembly 6 mounted on a blister pack 4. The connector assembly 6 is mounted over the landing 32, which therefore is not visible, on the corner 30 of blister pack. In this embodiment, the backing material for the blister pack 4 is a tablet with laminate filler to further stiffen the tablet. Although the internal layout of the connector assembly 6 is not visible in this view, the housing 34 of the connector assembly slides over the corner 30 to establish contact with landing 32. Leads 36 in communication with landing 32 extend from connector assembly for connection (directly or indirectly) with the microprocessor device having memory 10, see FIG. 1). The housing 34 is a dielectric material, such as a plastic, while the leads 36 are conductive, FIG. 5 depicts a header 8 and connector assembly 6, the header 8 separated from connector assembly 6 so that the header internals are visible. The header includes a housing 38. Header 8 includes a pocket 40 that mates with connector assembly 6 by sliding over connector assembly housing 34. Header 8 also includes a plurality of contacts, preferably pins 42, projecting into the pocket 40, the pocket protecting the pins from damage. When assembled the plurality of pins mate with the leads 36, the pins 42 preferably corresponding on a one to one basis with the leads 36. In this embodiment, the header 8 includes a second set of connections (not shown in FIG. 5) for communication with a microprocessor device having a memory. The second set of connections is in communication with pins 42. Preferably, the second set of connections are positioned on the side of the header housing 44 opposite the pocket 40 that protects the plurality of pins. The header 8 is readily assembled and disassembled from the connector assembly by any well known means. For example, a push button/detent arrangement may be used. As a further example, not meant to be limiting, a lever attachment/detachment arrangement may be used. In fact, a friction fit of the header 8 over the connector assembly 6 or the connector assembly over the header may be used.

The header 8 is connected to microprocessor device having a memory 10, but which can be remote from the microprocessor device. The header can be permanently positioned in a secure location. Because the connector assembly 6 can be removed readily from the header 8 as previously discussed, the blister pack 4 to which the connector assembly 6 is attached can be retained in a secure location until ready for use. There are many ways to make the blister pack ready for use. However, when ready for use, the connector assembly 6 is removed from the header 8 to allow transport of the blister pack if desired, and an article or unit of material is removed from the blister pack. On removal of the connector assembly 6 from the header 8, the circuit between the header 8 and connector assembly 6 is broken. When blister pack usage is complete, connector assembly 6 is reconnected to header 8. On reconnection, the circuit is restored. A signal sent out through the header 8, and the connector assembly 6 to the blister pack 4 can test the continuity of the circuits on the blister pack. The signal passes through the circuits and determines the number of circuits that have been broken, or alternatively, the number of circuits still intact. The microprocessor device having memory 10 compares the number of circuits remaining after return with the number of circuits that were intact before removal and determines how many articles or unit doses of material were removed while the blister pack was removed from the header 8 This information can then be stored in the microprocessor memory. In this way, the inventory of the articles or unit doses of material in a blister pack can be continuously tracked. By providing additional appropriate software requiring identification for access, the system can identify who had access to one or more blister packs, when and for how long. Furthermore, the system can restrict access to blister packs if appropriate identification is not provided. In this manner, responsibility for removal of the contents can also be assigned. Furthermore, if the article or unit dose of material is to be distributed to a third person such as for example a patient, the software can allow or require the accessing person to identify the ultimate recipient of the article or unit dose of material. Clearly, the system permits various levels of complexity, all of which is enabled by the header/connector assembly/blister pack combination.

Figure 6:
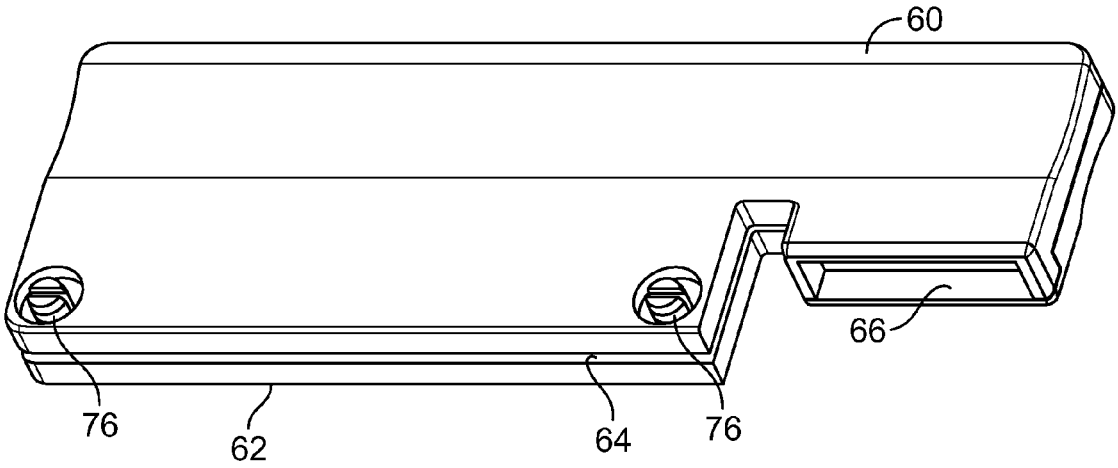
FIG. 6 depicts a preferred embodiment of the connector of the present invention.
Figure 7:
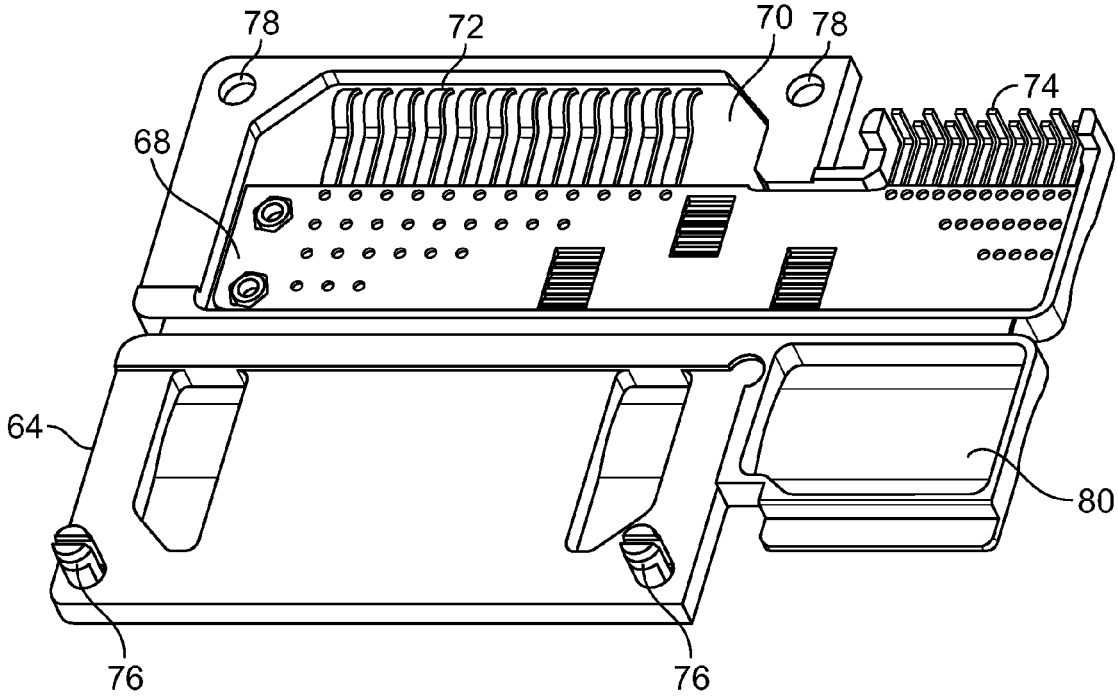
FIG. 7 depicts a preferred embodiment of the connector of the present invention with one of the covers removed.
Figure 9:
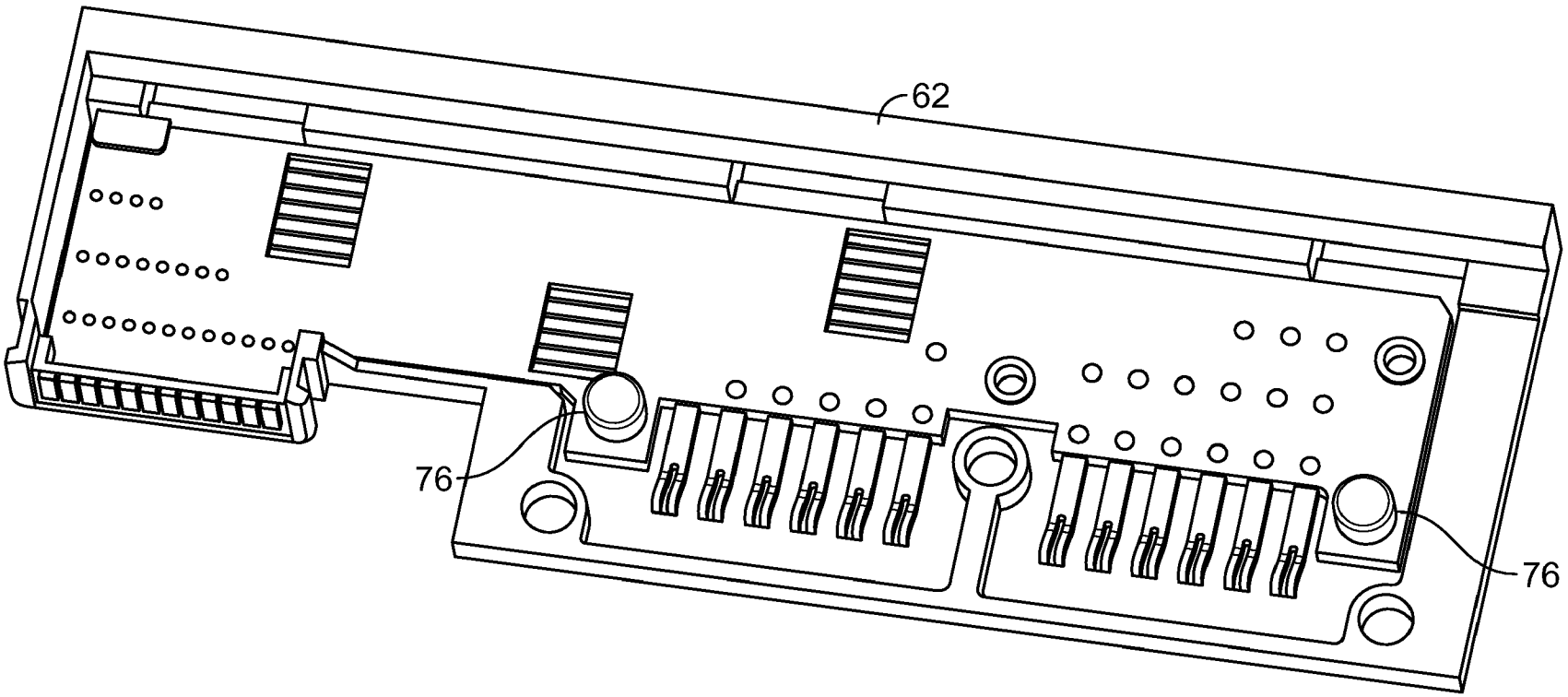
FIG. 9 depicts a preferred embodiment of the connector assembly disassembled from the blister pack.

FIGS. 6 and 7 depict a preferred embodiment of the connector assembly 6 of the present invention. FIG. 6 depicts the top cover 60 and bottom cover 62 forming the housing 34 of the connector assembly 6 assembled together. When assembled, a first gap or aperture 64 is located between the top and bottom covers. This first gap or aperture 64 receives a portion of the blister pack, preferably the blister pack corner 30. A second gap or aperture 66 is provided that optionally accepts a positive assembly/removal feature in the form of a button or a lever to facilitate assembly and removal of the header 8 from the connector assembly 6. In FIG. 7, the top cover 60 is removed, disclosing a circuit board 68 residing in a cavity 70 in the bottom cover. The circuit board 68 includes a first set of contacts 72 that reside within the cavity 70 and are enclosed within the housing 34 of the connector assembly when top cover 60 and bottom cover 62 are assembled together. Leads 74 extend to the exterior of the housing 34, or are readily accessible from the exterior of the housing, when the covers 60 and 62 are assembled together. Leads 74 and first set of contacts 72 are electrically connected to one another, each of the leads 74 electrically connected to a contact of the first set of contacts 72. The circuit board 68, as shown in FIG. 9, or the bottom cover 62 as shown in FIG. 7, further includes locating features, posts 76 in the preferred embodiment, that extend upward that are also visible in the assembled connector assembly, FIG. 6. As the locating features are used for location of the components during assembly, the specific component on which they are fabricated is not critical, as long as the top cover, bottom cover and blister board can be correctly located in relationship to one another. In a preferred embodiment, apertures 78 on bottom cover are also visible. A second cavity 80 in the bottom cover 62 lies adjacent leads.

Figure 8:
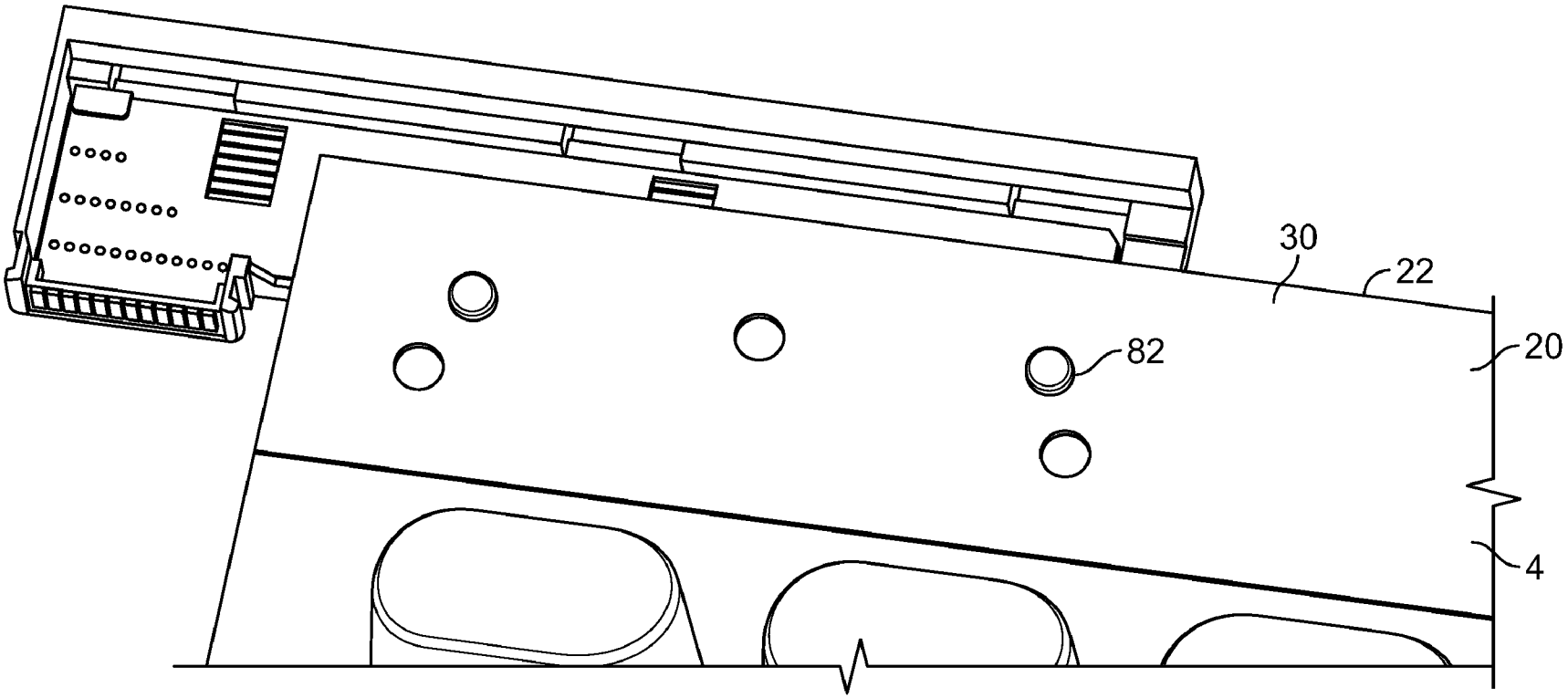
FIG. 8 depicts a blister pack assembly assembled over a circuit board in a cover of the present invention.

FIG. 8 depicts a partial assembled connector assembly in the sequence of assembly operations. A blister pack 4 is assembled onto a bottom cover 62 and partially over circuit board 68 of connector assembly 6. The blister pack corner 30 is depicted having a plurality of apertures 82. The first side of blister pack 20 from which a plurality of compartments 24 extend is opposite the circuit board 68, while second side of blister pack 22 is placed down onto circuit board 68. Locating features, preferably apertures 82 on the blister pack corner 30, are dimensioned so that they mate with the locating features, preferably posts 76 on connector assembly bottom cover 62. The posts and apertures align the blister pack 4 with the circuit board 68 so that the pads on landing 32 on second side of blister pack 22 (not visible in FIG. 8) are brought into alignment with first set of contacts 72 within connector assembly 6. The blister pack corner 30 is captured in first gap 64 when top cover 60 is assembled over posts 76, thereby attaching it to bottom cover 62. The top cover and bottom cover can be attached by any convenient means. Top cover 60 can include apertures permitting it to be snap fit over the bottom cover 62 using posts 76 and the apertures. Alternatively other snap means can be molded into the top and bottom covers. If desired, a separate fastener can be assembled through mating apertures in the top and bottom covers to hold the top and bottom covers together. In this embodiment, the leads 74 are external to the connector assembly 6 so that a header 8 can be assembled to it.

In another embodiment, the top cover and bottom cover can be molded as a single plastic piece with a plastic hinge intermediate the top cover and the bottom cover. The top cover can be folded along a bend line to bring the top cover proximate to the bottom cover to form a "living hinge." The circuit board and blister pack can be located on features preformed onto the single plastic piece and then fastened together as described above. However, to further simplify the assembly of the top and bottom cover, a retaining device can be molded into the single plastic piece to secure the top cover to the bottom cover when brought into mating engagement. Any interference fit would supply the engagement, such as a snap fitting.

Figure 10A:
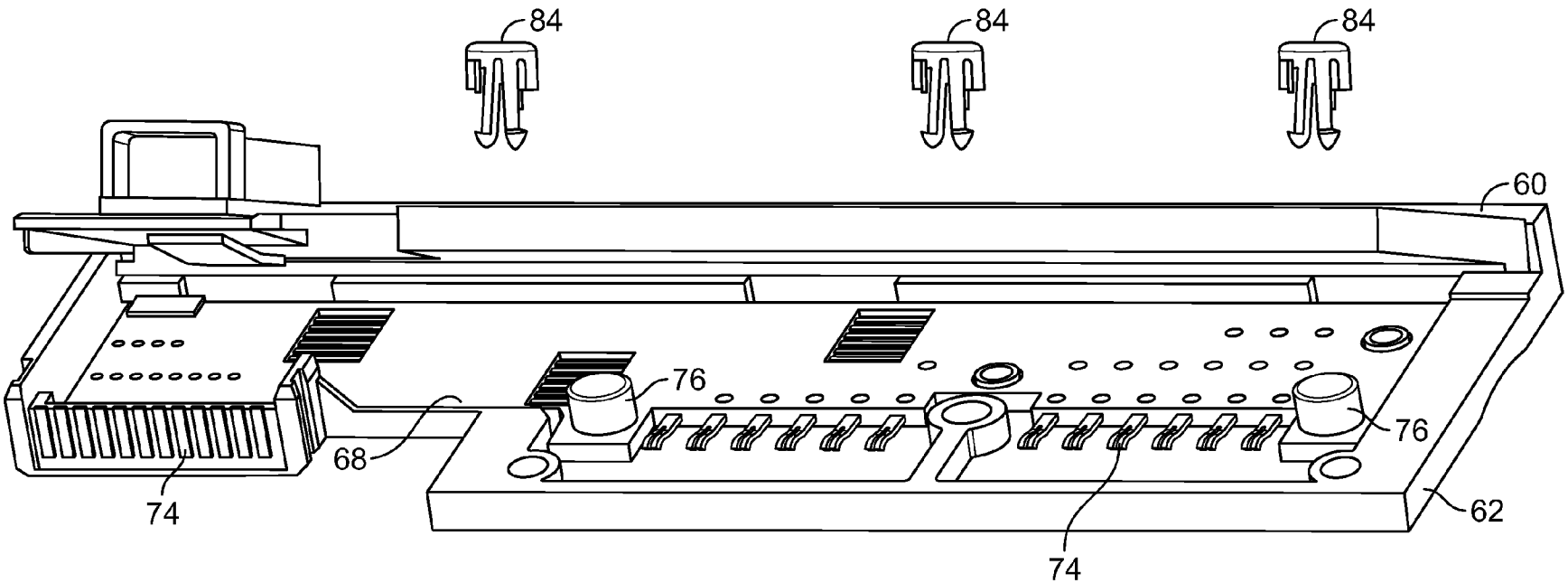
FIG. 10 is an exploded view of the connector assembly of the present invention.
Figure 10B:
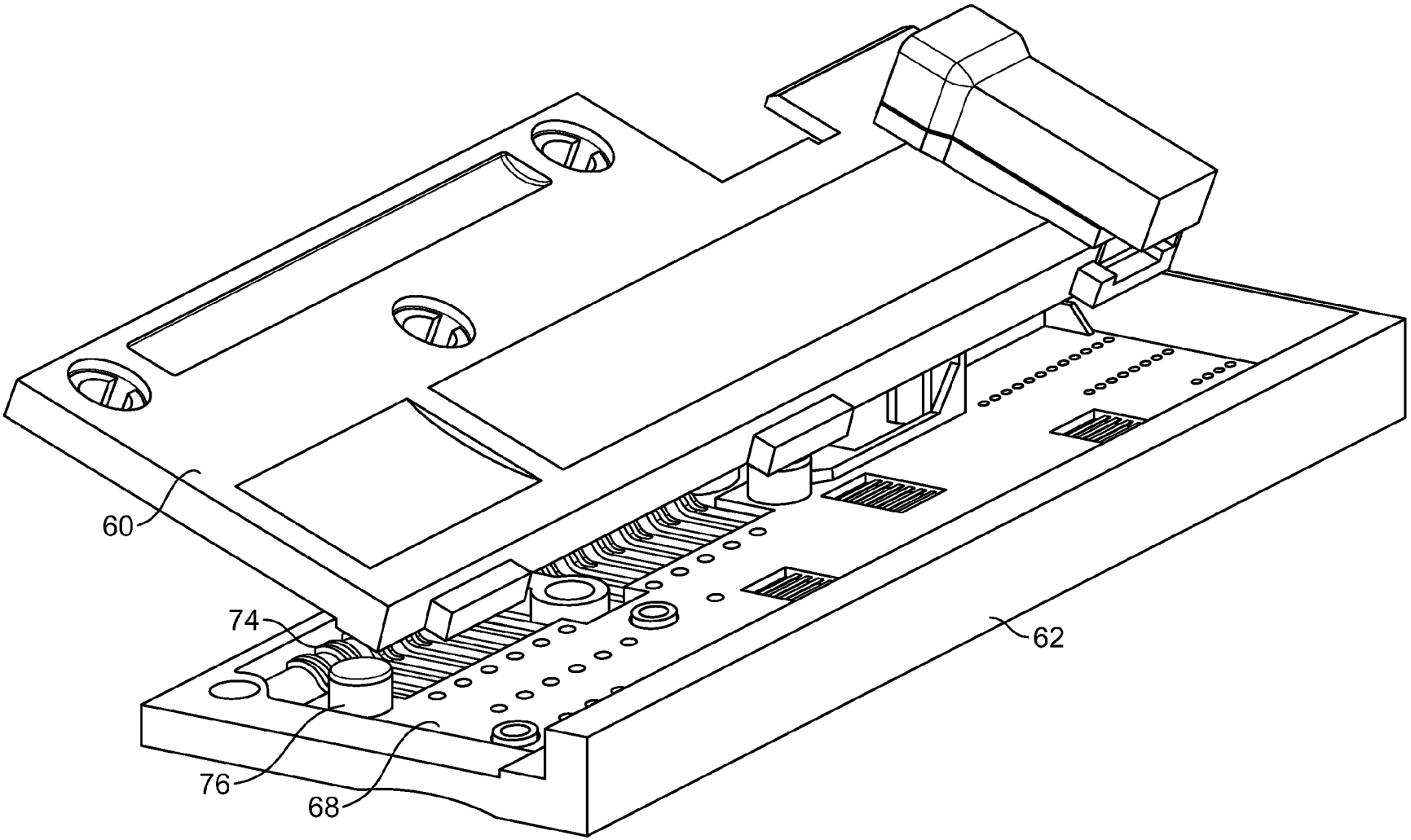
Figure 10C:
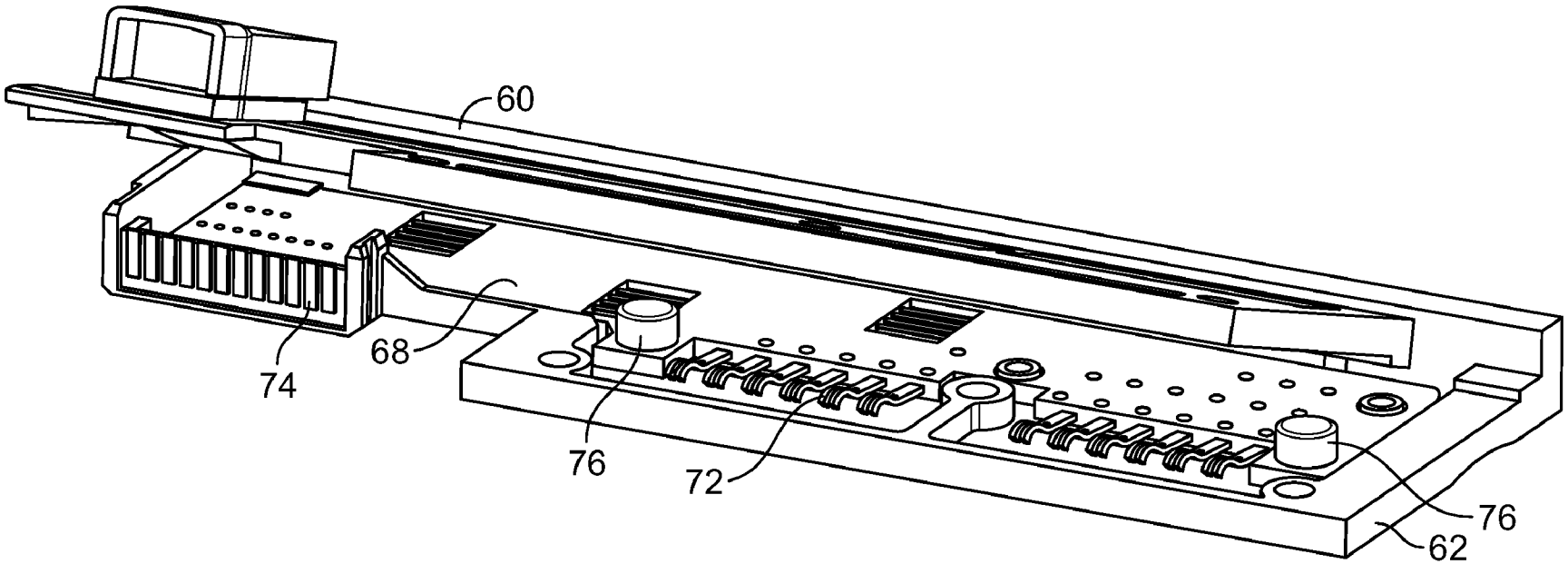

FIG. 10 is an exploded view of the connector assembly 6 of the present invention with the top cover 60 being assembled to the bottom cover 62. The blister board has been removed for clarity. Only FIG. 10A depicts separate fasteners 84, here snap fittings, used to fasten the connector assembly together while capturing the blister board therebetween. The use of fasteners is a significant aspect, since this permits the connector assembly 6 to be removed from an exhausted blister pack and reassembled to a new blister pack by simply removing and replacing fasteners 84. Leads 74 are positioned on the outside of the connector assembly 6.

Figure 11:
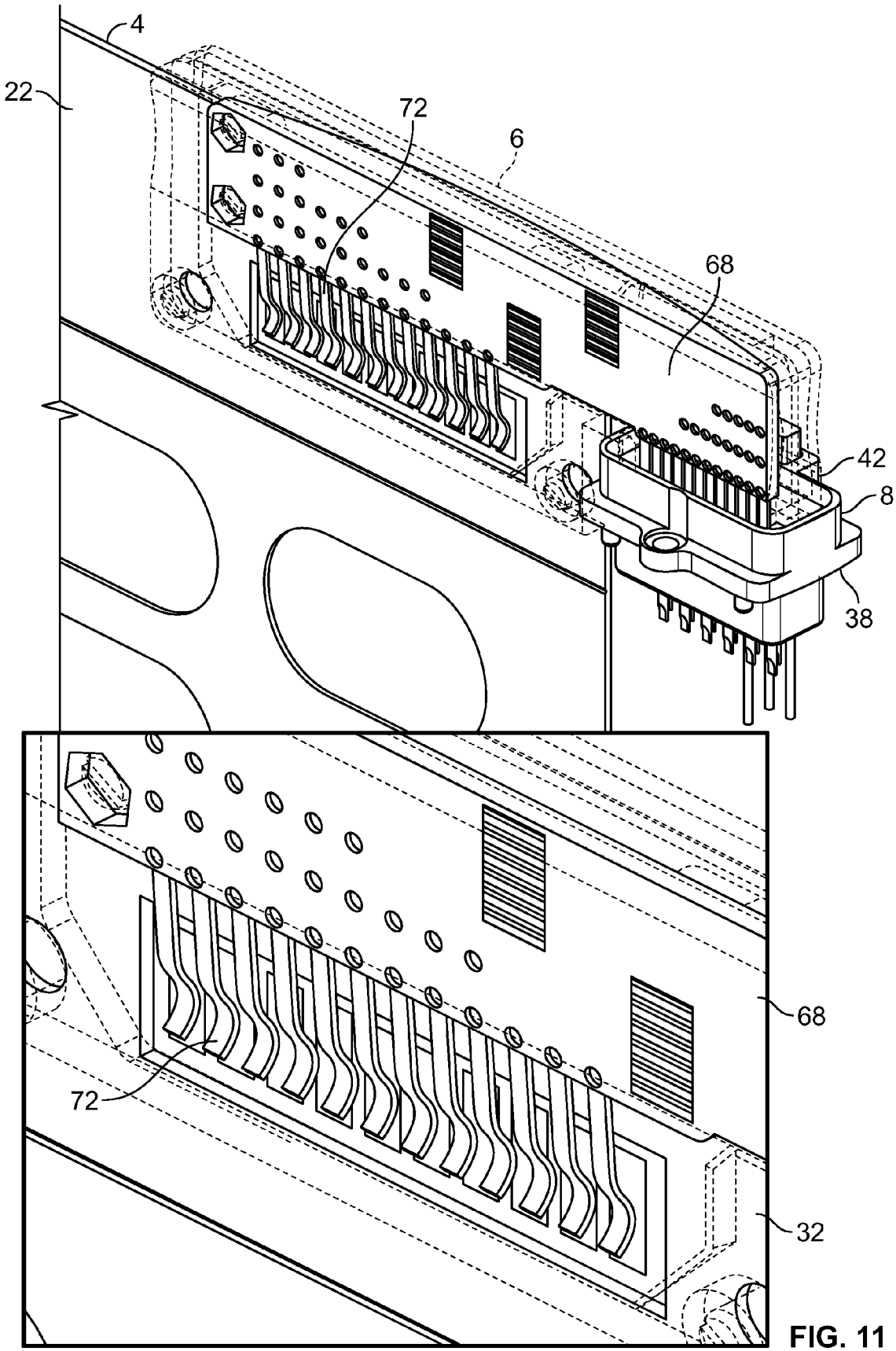
FIG. 11 depicts the assembly of the blister pack and header to the connector assembly, with the covers of the connector assembly shown in phantom.

FIG. 11 depicts a blister pack 4 assembled to the connector assembly 6, and a header 8 assembled to the connector assembly 6 in accordance with the present invention. The top cover and bottom cover of the connector assembly 6 are shown in phantom so that interaction of the circuit board 68 with both the landing 32 on the blister pack and the header 8 can be viewed clearly. The pins 42 of header 8 contact the leads (not shown in FIG. 11), and header housing is removably attached to connector assembly while pins 42 are urged into contact with leads 74. The header housing can be assembled to the connector assembly, preferably by a friction fit, and pulled from it. Preferably, a latch is positioned in cavity 80. When the blister pack 4 is required to be removed from the header, pressure is applied to the latch, which in turn transfers the force to the header housing 38 and urges the header 8 out of engagement with the connector assembly 6, so that the blister pack 4 can be removed and the header 8, which remains in place.

It will be understood in the art that the present invention discloses wired communications between the header 8 and the microprocessing unit with memory 10, the invention is not so limited. The header 8 and microprocessing unit with memory 10 can be provided with radio communications and the header, being provided with an appropriate power source, can be in two way RF communications using a transmitter/receiver (transceiver) with the microprocessor-controlled device having a memory 10. Alternatively, the header 8 can be provided with a microprocessor, a power source and a transmitter. On reconnection of the header 8 with the connector assembly 6, an electrical signal can be sent through the connector assembly 6 and blister pack circuits by the header 8, which determines the number of open (or closed) circuits.

The header transmits information indicative of the presence or absence of electrical signals, that is, the number of circuits 28 present and/or broken, which is an indication of the number of compartments 24 from which contents have been removed.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A reusable connector assembly for use with a blister pack, comprising:

a housing having a first cover and a second cover, the covers including at least one cavity, the housing having a gap configured to receive a portion of the blister pack;

a circuit board having a first set of contacts and a set of leads, the circuit board positioned within the at least one cavity of the housing so that the first set of contacts reside within the at least one cavity while the leads are located substantially on the exterior of the housing, the first set of contacts and set of leads being in electrical connection with one another so that at least one contact is in electrical connection with at least one lead;

the circuit board assembled into the housing cavity forming the connector assembly, the connector assembly further including locating features to locate the blister pack within the connector assembly so that the first set of contacts are in electrical connection with electrical contacts on the blister pack; and a fastening means for removably securing the blister pack to the connector assembly.

2. The connector assembly of claim 1 wherein the housing comprises a dielectric material.

3. The connector assembly of claim 2 wherein the dielectric material comprises a plastic material.

4. The connector assembly of claim 1 wherein the first cover and the second cover are connected with a hinge.

5. The connector assembly of claim 4 wherein the first cover, the second cover and the hinge comprise a single plastic part, the hinge being intermediate the first cover and the second cover and including a bend line to fold the first cover proximate the second cover.

6. The connector assembly of claim 5 further including a means for fastening the first cover to the second cover.

7. A connector assembly/header assembly for use with a blister pack, comprising:

a connector assembly, the connector assembly comprising, a housing having a first cover and a second cover, the covers including at least one cavity, the housing having a gap configured to receive a portion of the blister pack, a circuit board having a first set of contacts and a set of leads, the circuit board positioned within the at least one cavity of the housing so that the first set of contacts reside within the at least one cavity while the leads are located substantially on the exterior of the housing, the first set of contacts and set of leads being electrically connected with one another so that at least one contact is electrically connected with at least one lead, the circuit board assembled to the housing forming the connector assembly, the connector assembly further including locating features to locate the blister pack within the connector assembly so that the first set of contacts are electrically connected with printed circuits on the blister pack, and at least one fastener for removably securing the blister pack to the connector assembly;

a header, the header comprising, a housing, a plurality of pins extending from the housing and means for removably securing the header housing with the connector assembly so that the plurality of pins extending from the header housing are in electrical communication with the leads located substantially on the exterior of the housing; and means for communicating an electrical signal external to the header.

8. The connector assembly/header assembly of claim 7 wherein the header further includes a pocket, the plurality of pins positioned within the pocket and extending away from the header housing, the pocket protecting the pins from damage, the pocket fitting over the connector assembly, securing the header housing to the connector assembly.

9. The connector assembly/header assembly of claim 7 wherein the header is located in a substantially permanent position.

10. The connector assembly/header assembly of claim 7 wherein the header further includes a radio frequency transmitter/receiver and a power source for transmitting and receiving information indicative of the presence and absence of electrical signals.

11. The connector assembly/header assembly of claim 7 wherein the header includes a second set of leads in communication with the first set of leads, wherein the second set of leads are wired to communicate the electrical signal external to the header.

12. The connector assembly/header assembly of claim 7 wherein the connector assembly further includes a second gap that houses a lever extending from the connector assembly housing to facilitate assembly and removal of the header from the connector assembly.

13. The connector assembly/header assembly of claim 12 wherein the header is latched to the connector assembly, the lever activating and deactivating a latching mechanism.

14. The connector assembly/header assembly of claim 12 wherein the header is securely attached to the connector assembly and a force applied to the lever is transmitted to the header to urge the header out of engagement with the connector assembly.

15. An inventory control system, comprising:

a blister pack, the blister pack comprising a backing material having a first side and an opposed second side, a plurality of compartments sized to hold an article extending from the first side, a pierceable sheet covering the second side, the pierceable sheet including a plurality of printed circuits overlying each of the compartments, wherein the printed circuits extend toward an edge of the blister pack, the edge of the blister pack including locating features, and wherein removal of the article from one of the plurality of the compartments penetrates the pierceable sheet and breaks one of the plurality of printed circuits on the pierceable sheet;

a connector assembly, the connector assembly comprising, a housing having a first cover and a second cover, the covers including at least one cavity, the housing having a gap configured to receive a portion of the blister pack;

a circuit board having a first set of contacts and a set of leads, the circuit board positioned within the at least one cavity of the housing so that the first set of contacts reside within the at least one cavity while the leads are located substantially on the exterior of the housing, the first set of contacts and set of leads being in electrical communication with one another so that at least one contact is in electrical communication with at least one lead;

the circuit board assembled to the housing forming the connector assembly, the connector assembly further including locating features corresponding to the locating features on the blister pack so that the first set of contacts are in electrical communication with the blister pack printed circuits toward the edge of the blister pack; and at least one fastener for removably securing the blister pack to the connector assembly, a microprocessor controlled device having a memory; wherein the microprocessor controlled device having a memory determines number of the blister pack compartments having contents removed;

a header, the header comprising, a housing, a plurality of contacts extending from the housing and means for removably securing the header housing with the connector assembly so that the plurality of pins extending from the header housing are in electrical communication with the leads located substantially on the exterior of the housing; and means for communicating with the microprocessor controlled device having a memory, wherein breaking of one of the plurality of the printed circuits on the pierceable sheet by removal of the article from one of the plurality of compartments is detected by an electrical signal transmitted through the header, the connector assembly and the blister pack circuits when the header is connected to the connector assembly, the breaking of a circuit indicative of the removal of contents from a compartment, the breaking of the printed circuit communicated to the microprocessor controlled device having a memory which redetermines contents and stores redetermined contents in memory.

16. The inventory control system of claim 15 wherein the blister pack further includes a pierceable material comprising a metal foil, the plurality of printed circuits overlying the compartments being isolated from the metal foil by a thin layer of dielectric material positioned between the metal foil and each circuit of the plurality of printed circuits.

17. The inventory control system of claim 15 wherein the printed circuits extending to an edge of the blister pack extend to a corner of the blister pack.

18. The inventory control system of claim 17 wherein the locating features in the corner of the blister pack include at least two apertures.

19. The inventory control system of claim 18 wherein the locating features in the connector assembly include at least two posts corresponding to the at least two apertures.

20. The inventory control system of claim 15 wherein the printed circuits extending toward an edge of the blister pack terminate in a landing.

21. The inventory control system of claim 20 wherein the first set of contacts are in electrical communication with the landing when the blister pack is assembled to the connector assembly with their respective locating features aligned.

22. The inventory control system of claim 15 wherein the header is located in a substantially permanent position and the connector assembly with the blister pack is removably attached to the header.

23. The inventory control system of claim 15 wherein the header having means of communicating with the microprocessor controlled device having a memory includes a header having a power source and a radio frequency transceiver for transmitting and receiving information indicative of the presence and absence of electrical signals.

24. The inventory control system of claim 15 wherein the header having means of communicating with the microprocessor controlled device having a memory further includes a second set of leads in communication with the first set of leads, wherein the second set of leads are wired to be in electrical communication with the microprocessor device.

25. The inventory control system of claim 15 wherein the header further includes a power source and a microprocessor for transmitting an electrical signal through the connector assembly and the blister pack to determine the number of open or broken circuits, and a transmitter for transmitting information indicative of the number of open or broken circuits to the microprocessor controlled device having a memory.

26. The inventory control system of claim 15 wherein the blister pack having a backing material includes a backing material comprising cardboard.

* * * * *